US005326189A

United States Patent [19]

Beamer

[11] Patent Number: 5,326,189

[45] Date of Patent: Jul. 5, 1994

[54] METHOD AND APPARATUS FOR FORMING A TRENCH WITH GRATES OR SOLID COVERS

[75] Inventor: John V. Beamer, Atlanta, Ga.

[73] Assignee: Construction Casting Company, Atlanta, Ga.

[21] Appl. No.: 962,985

[22] Filed: Oct. 16, 1992

[51] Int. Cl.[5] ..... E02B 5/00

[52] U.S. Cl. ..... 405/119; 249/9; 404/4; 405/118

[58] Field of Search ..... 405/118, 119, 121, 124, 405/125; 249/1, 3-9, 207, 208, 209; 404/2, 4

[56] References Cited

U.S. PATENT DOCUMENTS

| | | | |
|---|---|---|---|
| 786,305 | 4/1905 | McIntyre . | |
| 1,274,618 | 8/1918 | Smith . | |
| 1,562,780 | 11/1925 | Mickelson . | |
| 1,566,319 | 12/1925 | Fischer | 404/74 |
| 1,700,889 | 2/1929 | Heltzel | 249/9 X |
| 2,102,528 | 12/1937 | Hall | 404/74 X |
| 2,554,522 | 5/1951 | Carter | 404/74 X |
| 2,843,913 | 7/1958 | Barron . | |
| 2,917,804 | 12/1959 | Barron . | |
| 3,207,465 | 9/1965 | Papin | 249/34 |
| 3,378,968 | 4/1968 | Shoemaker | 52/155 |
| 3,567,171 | 3/1971 | Slominski | 249/9 |
| 4,498,807 | 2/1985 | Kirkpatrick et al. | 405/43 |
| 4,787,773 | 11/1988 | Kehler | 405/118 |
| 4,840,515 | 6/1989 | Freese | 405/45 |
| 4,844,655 | 7/1989 | Aleshire | 405/118 |
| 4,878,782 | 11/1989 | Beattie et al. | 405/119 |
| 4,968,179 | 11/1990 | Frahm | 405/53 |
| 4,993,877 | 2/1991 | Beamer | 405/282 |
| 4,993,878 | 2/1991 | Beamer | 405/282 |
| 5,000,621 | 3/1991 | Beamer | 405/282 |

FOREIGN PATENT DOCUMENTS

3018331A1 5/1980 Fed. Rep. of Germany .

*Primary Examiner*—Dennis L. Taylor
*Attorney, Agent, or Firm*—Needle & Rosenberg

[57] ABSTRACT

A method and apparatus for forming a trench with grates or solid covers comprising an outer shell which is disposed between opposed frame members at a certain position, within a ditch and an inner core that is received within a channel in the shell. The core aids in providing rigidity to the shell while concrete hardens about the outer surface of the shell. After the concrete or other encasing material sets, the core can be removed from the shell which then enables the shell to be more easily displaced from the formed trench. One end of a core can project outwardly from an end of its shell so as to be received within the space formed in the rear of the channel of an abutting shell which, likewise, has its core projecting beyond its front end wall, thereby helping to align the shells within the trench.

5 Claims, 2 Drawing Sheets

METHOD AND APPARATUS FOR FORMING A TRENCH WITH GRATES OR SOLID COVERS

BACKGROUND OF THE INVENTION

The present invention relates to the construction industry and more specifically to the formation of a trench with grates or solid covers. The present invention includes an assembly for forming the trench with grates or solid covers and a novel two or more piece removable pre-shaped trench form which acts both as a male/female connecting system joining one form securely to another while at the same time simplifying the removal of the form after the material surrounding the two or more piece form has hardened.

In the prior art, a single piece pre-shaped form with a frame was used to form a trench with grates or solid covers. To form a relatively long trench, multiple trench form assemblies were laid in contiguous alignment end-to-end. Tape was placed at the adjacent ends so as to prevent upward seepage of concrete when the concrete or other material was poured into the trench and to connect one form to another. The use of tape did not provide adequate stabilization to prevent one form from getting out of alignment with another. The lack of adequate stabilization from form to form caused the system to come unconnected during the installation of the forms or to become misaligned during the pouring of the concrete.

In the prior art, the removal of the single piece trench form was very difficult due to the pressure of the surrounding concrete or other material which held the trench form very tightly in place. One would have to take the single piece trench form out in individual, small pieces; or, in some instances, by pulling on a wire or wires or re-rod embedded in the lower surfaces of the mold, thereby tearing through the mold to the top surface. This became a time consuming and frustrating procedure.

It can be seen that the prior system does not allow each trench form to be easily and economically connected to the next in such a way to strengthen the system as a whole so that it may be laid for great distances. It can also be seen in that the method for removal of the single pre-formed form is frequently very difficult. The prior art system results in less than optimal form stability during the pouring of the concrete or other surrounding material and additional time is frequently required in the removal of the single pre-formed trench mold.

Therefore, there exists a need for an improved method for connecting one form to another form.

There exists a need for improving stabilization of the entire trench form while in place, so not to get one trench form out of alignment with one another adjacent trench form.

There further exists a need for an improved method for removal of a pre-shaped trench form.

SUMMARY OF THE INVENTION

The disadvantages of the prior art are overcome by the present invention which relates to a novel two or more piece preshaped form for forming a trench with grates or solid covers and a simplified method for removal of such a form.

A removable two or more piece pre-shaped form for a grate-covered trench is held in a fixed position between two frames. The two or more piece pre-shaped form for a trench with grates or solid covers is preferably made of expanded polystyrene, although other easily-shaped removable materials may be used. The form has a flat upper surface and a shaped lower surface. The shape of the lower surface is constructed to approximate the shape of the desired trench. The form typically extends the length of the frames but may be made in longer or shorter pieces.

The two or more piece pre-shaped form is made up of an outer shell or shells and an inner core or cores. A purpose of the inner core is to be able to remove it from the interior of the shell so that the outer shell's exterior walls and bottom wall will be more easily removed from the concrete surface or other surrounding materials surface. Also, the inner core is movable horizontally within the shell in order to form a connection with an adjacent shell. This would normally be done by moving the core forward perhaps one or more inches, making a male connection at one end of the shell, thereby forming a female connection at the other end of the shell. The same horizontal movement of the inner core in each adjacent channel forms a lock between channel to adjacent channel. This provides a better quality trench due to the added stabilization to ensure proper trench form alignment, and providing a trench form that is capable of being laid for very great distances.

Another feature of the inner core and outer shell of the trench form of the present invention is that during the shipment of the form, the core ends may be pushed back into alignment with the ends of the shell, to reduce chances of damage during shipping. The trench forms outer shell and the inner core also greatly ease the removal of the trench form from the concrete or other materials surrounding it. Removal of the trench form is simplified by removing one or more of the inner core pieces. For instance, the claw of a claw hammer, a crow bar, a pick or other device could be used to dig into the inner core pieces which easily lift out of each form, leaving the outer shell of the form. This releases the pressure of the concrete or other surrounding material. The outer shells exterior walls may then be broken down into the cavity and the outer shells bottom can be pulled up into and removed from the cavity with the simple use of the claw on the claw hammer, a crow bar, a pick or other device. The removal of the form from the trench would then be complete. The final product is a trench with grates or solid covers having the desired characteristics, and slope of the shaped form.

It can be seen, therefore, that it is an object of the present invention to provide an improved method of removal of a trench which is simple and quick.

It is also an object of the present invention to provide a method of economically and easily connecting one form to another form to create a form that can be accurately laid very long distances.

It is an object of the present invention to provide a method of connecting one form to another form that will provide additional stabilization to the form.

It is also an object of the present invention to provide a form which can be easily shipped without protruding fragile components easily damaged during shipping.

It is also an object of the present invention to provide a trench form in which a shaped mold may be used to form a trench having the characteristics and slope of the shaped form.

DETAILED DESCRIPTION OF THE PREFERRED EMBODIMENT

Figure 1:
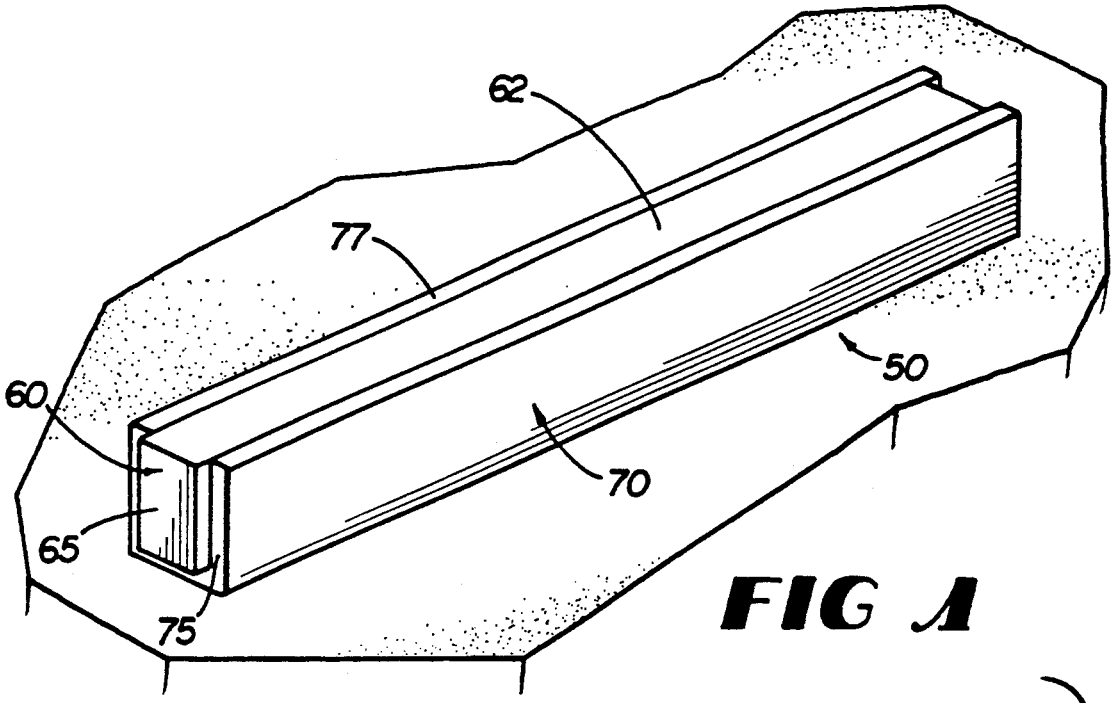
FIG. 1 is a perspective view of a removable pre-shaped form of the present invention having a male/-female connection system comprising an outside shell and a removable center core.
Figure 2:
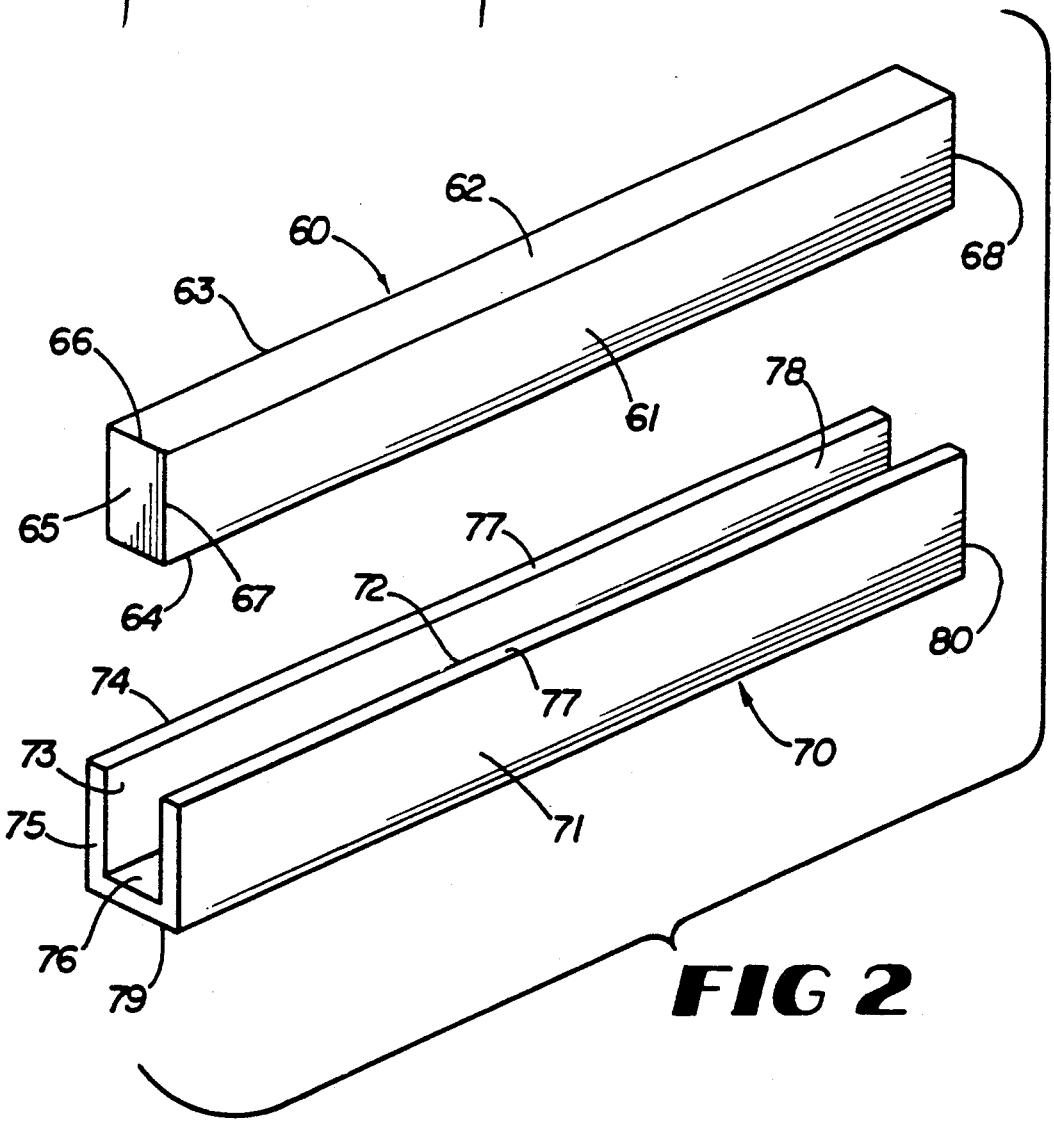
FIG. 2 is an extended perspective view of the present invention.

Referring to FIGS. 1 and 2, the present invention form 50 is shown comprising an outer shell 70 and a removable core 60 which fits snugly inside, and is slidable within, shell 70. The core 60 is shown in FIG. 2 to have a substantially rectangular shape with upright, parallel side walls 61, flat top 62, opposed flat bottom 64 and upright opposed end walls 65, 68. Juncture 67 is where the side walls 61, 63 and the end walls 65, 68 meet with line 66 being where the ends of the top 62 are joined to end walls 65, 68.

The shell 70 comprises upstanding outer side walls 71, 74, bottom 79, front wall 75, rear wall 80, and top 77. A generally U-shaped channel 78, which opens through top surface 77 and walls 75, 80, longitudinally extends along shell 70, and is defined by interior side walls 72, 73 and bottom surface 76. The cross-sectional shape of channel 78 is complimentary to core 60. It is preferable, but not necessary, that the top 62 of the core 60 be flush with the top 77 of the shell 70. The core 60 can be constructed of a material having a density which is lighter, heavier, or the same as the material for the shell 70, such as expanded polystyrene.

Various methods may be used to attach the form to the frame assemblies at the proper height. To illustrate one such method of the working environment of the present invention 50, reference is made to U.S. Pat. No. 4,993,878 issued on Feb. 19, 1991 and the removable form 142 disclosed therein. The form 50 made up of the shell 70 and the core 60 will be positioned between a pair of frame assemblies (not shown) that have been positioned by any suitable means relative to the ground after a ditch of the proper depth has been dug. Thus, means (not shown) are provided on the form 50 so that it can be fixed to the frame assemblies at the proper height within the ditch. Other methods may or may not include provisions on the form for attachment to the frame. For example, a wire or other materials may be simply wrapped around the frames and under or through the form 50. These examples show various, but by no means all of the methods of attachment of the form 50 to the frames. It is understood that bottom 79 of the shell 70 may have any desired shape to conform to the interior of the trench that has been dug (See e.g., FIGS. 6–8)

In order to insure the alignment and stabilization of contiguous forms 50 along the trench, the forms core 60 can be utilized to extend into adjacent forms shell 70 as follows: the front end wall 65 on the core 60 within a first shell 70 can be pushed forward so that it projects beyond the face of front wall 75 on the first shell 70. The adjacent or second shell 70 with its associated second core 60 (not shown) would have its rear wall 80 in abutting engagement with the front wall 75 of the first shell 70. The second core 60 within the second shell 70 would be moved forward so as to form a space within the channel 78 adjacent the rear wall 80 of the second shell 70 that would receive therein the projecting portion of the core 60 of the first shell 70. This male/female connection of the cores 60 within the shells 70 is repeated the length of the trench.

Concrete, or other appropriate encasing material, is then placed in the trench so as to encase the outer side walls 71, 74 and bottom 79. After the concrete or other encasing material hardens the form 50 is removed therefrom in two steps. First, core 60 is removed using claws on a hammer, a crow bar, a pick or other device which will pull or pick out core 60 from shell 70. When this is accomplished, outer shell 70 can then be removed by collapsing inwardly the outer shell walls 71, into the channel 78. Again, the use of claws on a hammer, a crow bar, a pick or other suitable device will be used to remove shell 70 so as to form a clean trench.

Figure 3:
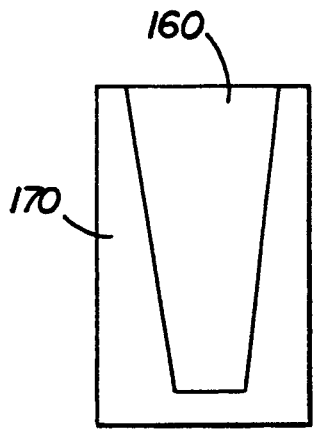
FIG. 3–8 are end views of various embodiments of the present invention.
Figure 4:
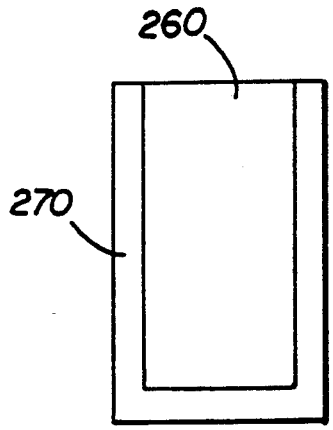
Figure 5:
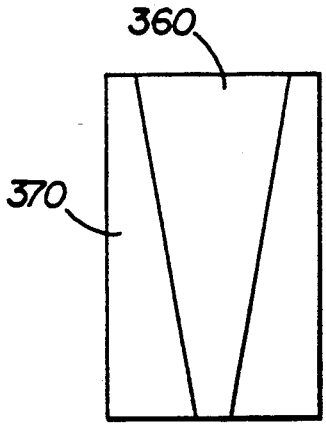
Figure 6:
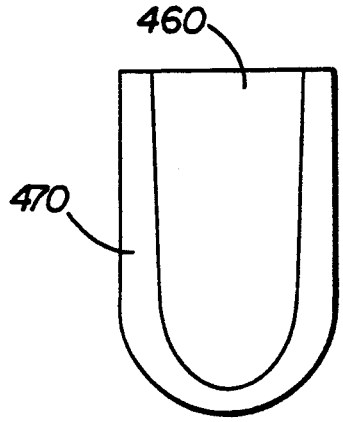
Figure 7:
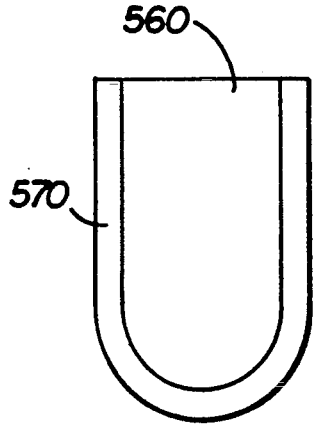
Figure 8:
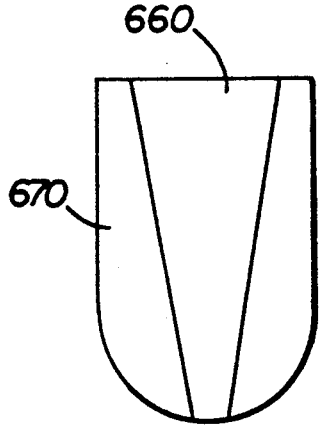

FIGS. 3 through 8 show various, but by no means all, of the embodiments that the removable pre-shaped forms 50 may take. FIG. 3 shows a trapezoidal removable core 160 tapered for easier removal from outer shell 170. FIG. 4 shows a rectangular removable core 260 which would leave an outer shell 270 which is thinner in cross-section than shell 60. FIG. 5 shows a trapezoidal-shaped removable core 360 extending completely through the bottom of and, thus, becoming a part of the outer shell 370. FIG. 6 shows an elliptical removable core 460 tapered for easy removal from outer shells 470. FIG. 7 shows a removable core 560 and outer shell 570 which are similar in shape to core 460 and shell 460 but leaves a thinner shell 570 when the core 560 is removed. FIG. 8 shows a trapezoidal removable core 660 extending completely through the lower part of the outer shell 670 which has a rounded bottom.

The above embodiments of the trench form are shown with a unitary core for each outer shell but it is understood that a plurality of cores could be utilized per shell. A requirement of any core used in the present invention is that it allow the outer shell to remain rigid while the encasing material about the shell sets.

What I claim is:

1. An improved trench form for shaping a trench of the type wherein the form is disposed within a ditch between two frame assemblies, concrete is poured within the ditch to encase the outer surface of the trench form and, after the concrete or other encasing material hardens, the form is removed, the improvement comprising:

(a) an elongated, rigid outer shell having upright opposed side walls, a forward end wall and an opposite rear end wall, a top wall and a bottom and having a channel longitudinally extending therethrough which is open through the end walls and the tope walls; and (b) a core that is positioned within and is removable from the channel and having opposed ends, a top and a bottom surface and a shape which is complimentary to the shape of the channel, whereby, after the concrete hardens, the core is removed from the shell and then the shell is removed from the concrete.

2. An improved trench form as claimed in claim 1 wherein the density of the core is the same as, heavier or lighter than the density of the shell.

3. An improved trench form as claimed in claim 1 wherein the core is expanded polystyrene or other formable materials.

4. An improved trench form as claimed in claim 1 wherein one end of the core extends beyond the forward end wall of the shell and wherein a space is formed within the channel between the opposite end of the core and the rear end wall of the shell to receive therein the forward end of an adjacent core.

5. A method of making a trench, comprising the steps of:

(a) forming a ditch in the ground;

(b) fixing at a preselected depth within the ditch a first trench form comprising a first outer shell having first and second end walls and a top wall and a first core received within a channel longitudinally extending through the end walls and top wall of the shell;

(c) extending a portion of one end of the first core beyond the first end wall of the first shell;

(d) positioning a second core within a second shell of a second form so that one end of the core extends beyond the first end wall of the second shell, thereby forming in the channel at the end of the second shell adjacent the second end wall a space sufficient to receive therein the portion of the first core which projects outwardly from the first end wall of the first shell;

(e) placing the second form in the ditch with the second end wall of the second shell in abutting relation to the first end wall of the first shell, the end of the first core that projects beyond the first end wall of the first shell being received within the space in the channel of the second shell; and (f) repeating steps (d) and (e) for subsequent shells and respective cores along the length of the trench.

* * * * *